United States Patent [19]

Schlecht

[11] 3,982,857

[45] Sept. 28, 1976

[54] SUPPORT MEANS FOR MOVABLE CONNECTOR IN CONCRETE PUMP ARRANGEMENT

[76] Inventor: Karl Schlecht, Echterdinger Str. 91, D-7024 Bernhausen, Germany

[22] Filed: Oct. 15, 1974

[21] Appl. No.: 514,387

[30] Foreign Application Priority Data

Oct. 17, 1973 Switzerland ..... 14673/73

[52] U.S. Cl. ..... 417/519; 417/900

[51] Int. Cl.[2] ..... F04B 15/02

[58] Field of Search ..... 417/900, 516, 517, 518, 417/519, 512

[56] References Cited

UNITED STATES PATENTS

| | | | |
|---|---|---|---|
| 2,854,170 | 9/1958 | Borgardt et al. | 417/900 |
| 3,298,322 | 1/1967 | Sherrod | 417/900 X |
| 3,380,388 | 4/1968 | Sherrod | 417/313 |
| 3,663,129 | 5/1972 | Antosh | 417/516 |
| 3,726,614 | 4/1973 | Schellenberg | 417/900 X |
| 3,741,691 | 6/1973 | Schwing | 417/519 X |
| 3,832,097 | 8/1974 | Schlecht | 417/900 X |

OTHER PUBLICATIONS

Putzmeister, "The Elephant Trunk," Maschinenfabrik GmbH, Bernhausen, W. Germany, 1973.

*Primary Examiner*—Carlton R. Croyle
*Assistant Examiner*—Thomas I. Ross
*Attorney, Agent, or Firm*—Hans Berman

[57] ABSTRACT

The cylinders of two plunger-type slurry pumps on a truck delivering concrete mixture to a constructions site are connected to openings in the bottom of a bin and alternatively connected to a discharge conduit by a tubular connector movable in the bin between positions of at least approximate sealing engagement with the openings. The useful life of the connector and of associated devices is improved by supporting the connector on a rigid frame above the bin.

13 Claims, 8 Drawing Figures

SUPPORT MEANS FOR MOVABLE CONNECTOR IN CONCRETE PUMP ARRANGEMENT

This invention relates to slurry pump arrangements, and will be described with specific reference to an arrangement for pumping concrete mixture ready to be poured.

It is known to equip concrete mixing trucks with two plunger-type pumps which are permanently connected to openings in the bottom wall of a container, such as a bin. A tubular connector is at least partly arranged in the container and may be moved between two positions in which it engages the bottom wall about the two openings respectively and connects the engaged opening with a discharge conduit. The plungers have a common drive which causes fluid concrete mixtue to be drawn into one cylinder from the bin while the mixture is expelled from the other cylinder through the connector and the discharge conduit.

The effectiveness of the dual pump arrangement depends on the tightness of the seal between the moving lower orifice of the connector and the bottom wall of the bin about the openings. The high pressure necessary for pumping the very viscous concrete mixture and the abrasive nature of the mixture make it difficult to maintain a tight seal between the connector and the bottom wall of the bin.

Distortion of the supporting structure for the movable connector in the known pump arrangements has now been found to be a major factor in shortening the useful life of apparatus of this type known heretofore. It has furthermore been found that such disadvantages of the known slurry pump arrangements for concrete mixing trucks can be avoided by mounting the tubular connector on a portion of the common, stationary support for the bin and the pump cylinders which is upwardly spaced from the bin, and may be integral with the upper flange or the backwall of the bin.

The support preferably includes a frame having two upright columns and two transverse beams connecting the columns and vertically spaced from each other. The connector, according to a more specific aspect of this invention, is movably supported on the one beam which is vertically spaced in an upward direction from the other beam.

Other features and objects, as well as the attending advantages of this invention will readily become apparent from the following description of preferred embodiments of this invention when considered in connection with the appended drawing in which.

Figure 1:
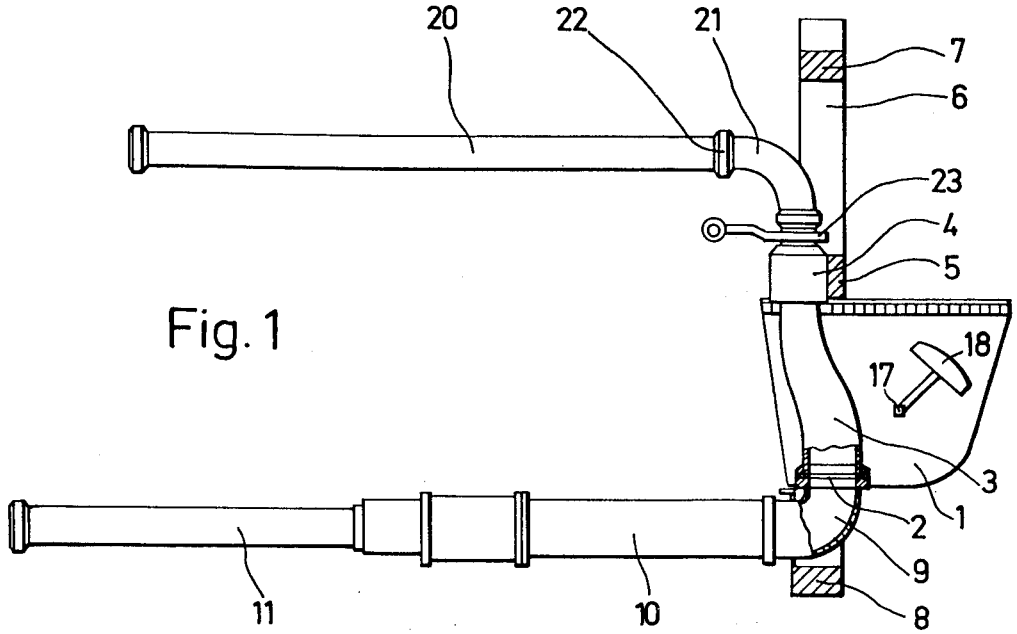
FIG. 1 shows a slurry pump arrangement of the invention in side elevation and partly in section.

Referring initially to FIG. 1, there is shown a shallow bin 1, elongated at right angles to the plane of FIG. 1, whose side walls taper downward toward a bottom wall having two circular openings 2 and a raised rim about each opening, only one opening being seen in FIG. 1. A connector 3 which is a tube bent into the approximate shape of a stretched-out S is mounted by means of a bearing 4 in a transverse beam 5 of a heavy steel frame which also includes two upright columns 6, another transverse beam 7 above the beam 5, and a bottom beam 8.

An elbow 9 fixedly attached to the outside of the bin 1 permanently connects each of the two openings 2 to the cylinder 10 of a slurry pump, the piston or plunger of the pump being obscured in the drawing and being mounted on the piston rod also obscured, of a double-acting hydraulic actuator 11, the tin, pump cylinder and actuator being fixedly mounted on the stationary support structure partly represented by the frame 5-8.

An arm 23 attached to the tubular connector 3 near its upper orifice can pivot the connector 3 about the vertical axis of the bearing 4 between two positions in which the lower orifice of the connector engages the bottom wall of the bin 1 about the two openings 2 respectively, the other opening communicating with the bin. A stop 18 pivotally mounted on a shaft 17 may be swung into the path of the connector 3 to secure the same in either position.

A rotary seal, not explicitly shown and conventional, connects the upper orifice of the connector 3 to an elbow 21, the elbow being fixedly attached to a discharge conduit 20 parallel to the axes of the cylinders 10 and located in an upright plane which passes between the two cylinders. The conduit 20 is fixedly attached to the supporting structure in a manner not explicitly shown.

Figure 2:
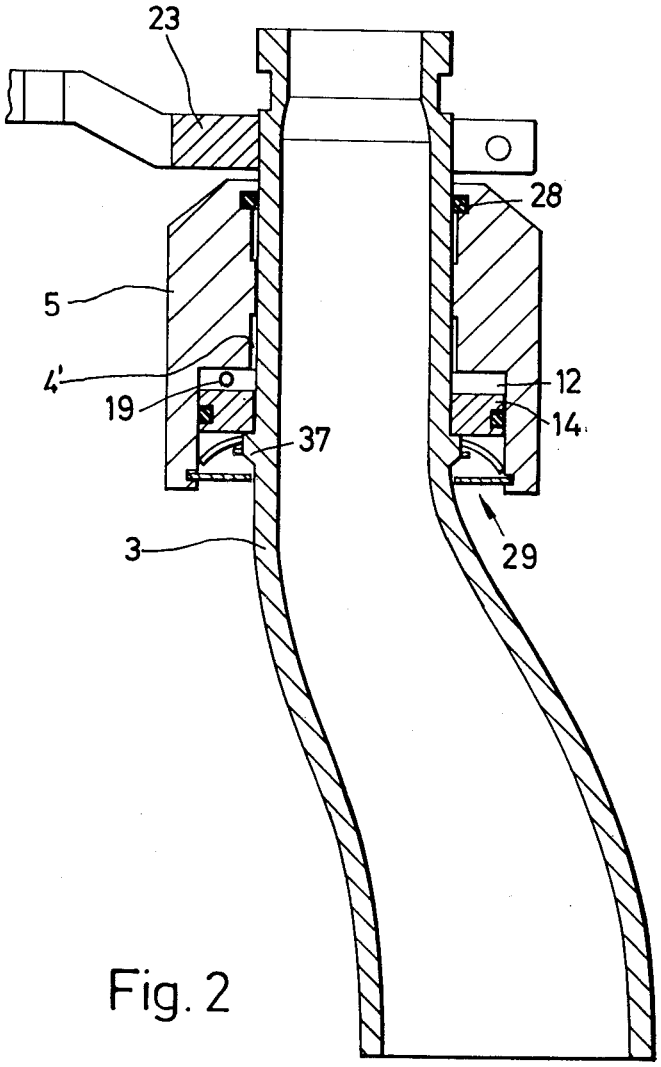
FIG. 2 shows elements of the arrangement of FIG. 1 in side-elevational section on a larger scale.

As is shown in FIG. 2, the bearing 4 is provided by a bore of stepped cylindrical shape in the beam 5 and includes two axially spaced bearing sleeves 4′ in the bore. A sealing ring 28 partly recessed in the beam 5 and movably engaging the connector 3 upwardly seals the bore.

The lower end of the bore is enlarged to provide a cylinder space 12 downwardly bounded by an annular piston 14 axially slidable on the connector 3 toward and away from an annular shoulder 37. A labyrinth 29 protects the cylinder space against airborne contamination. The hydraulic system, not otherwise illustrated, which also supplies the actuators 11 and the hydraulic motor (not shown) which operates the arm 23 includes a conduit 19 leading into the space 12.

The apparatus shown in FIGS. 1 and 2 is operated by an automatic reversing valve in a largely conventional hydraulic system as follows:

While the two actuators 11 stand still, the connector 3 is shifted from one opening 2 connected with a concrete-filled cylinder 10 to the other opening 2. Pressure fluid is then admitted to the two actuators 11 and to the cylinder space 12. The piston 14, abutting against the shoulder 37, presses the lower orifice of the connector 3 against the bottom wall of the bin 1 about the engaged opening 2. Concrete mixture is pushed by the corresponding actuator 11 and pump 10 through the connector 3 into the discharge conduit 20 and outward of the latter while the other pump 10 simultaneously draws fluid concrete mixture from the cavity of the bin 1. At the completion of the pump strokes, the cylinder space 12 is opened toward the sump of the nonillustrated hydraulic system, thereby relieving the contact pressure between the lower orifice of the connector 3 and the bottom wall of the bin 1, and facilitating subsequent angular shifting of the connector 3 as the next cycle begins.

The fluid pressure in the connector 3 which tends to drive the connector 3 upward and away from the bin bottom and the fluid pressure in the cylinder space 12 are absorbed by the heavy steel frame 5, 6, 7, 8 without measurable distortion. Downward movement of the bottom wall in the bin 1 can be prevented, if necessary, by steel spacer blocks placed between the elbow 9 and the beam 8. An adequate seal between the lower orifice of the connector 3 and the bin bottom can thus be maintained over an extended period, any wear of the engaged sealing surfaces being compensated for by the pressure of the fluid in the cylinder space 12.

Figure 3:
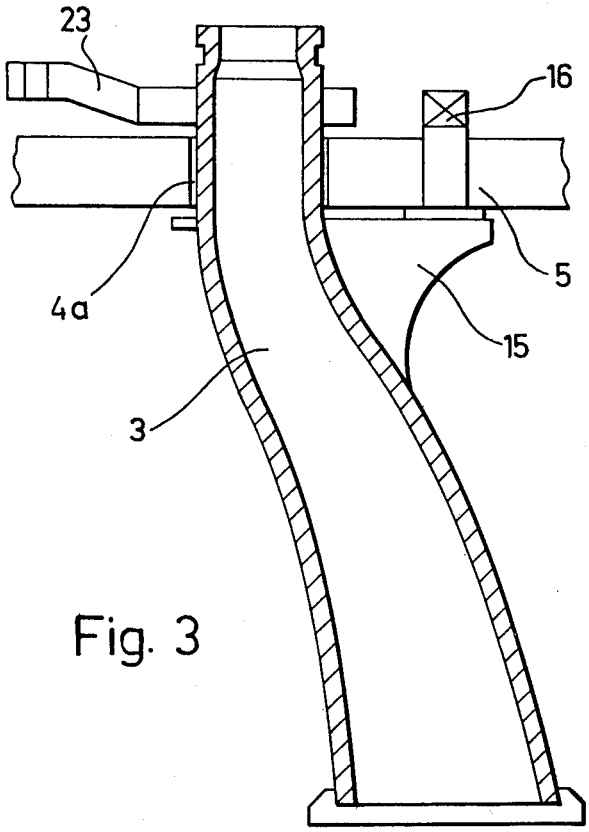
FIG. 3 illustrates a modification of the device of FIG. 2 on a smaller scale.
Figure 4:
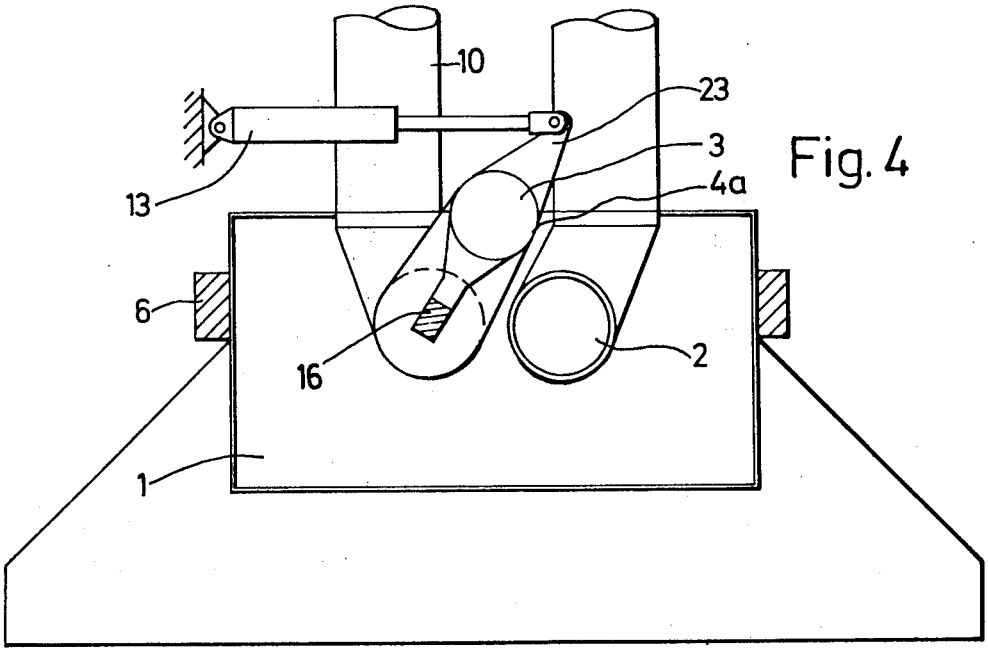
FIG. 4 is a fragmentary view in top plan section of a slurry pump arrangement including the device of FIG. 3.

The modified apparatus of the invention partly shown in FIGS. 3 and 4 is identical with that described above except as specifically shown in the drawing and described hereinbelow. It operates in a manner obvious from the preceding paragraphs.

The bearing 4a which pivotally connects the connector 3 to the beam 5 in FIG. 3 is a plain sleeve bearing. The proper axial position of the connector 3 is maintained by a bracket 15 on the connector 3 having a horizontal abutment face directed upward toward a threaded abutment 16 vertically adjustable on the beam 5 by means of a wrench (not shown) engaging the square end of the abutment 16 which projects upward from the beam 5. FIG. 4 shows the double-acting hydraulic motor 13, omitted from FIGS. 1 to 3, which is interposed between the arm 23 and the stationary support structure for shifting the connector 3 between its two positions.

Figure 5:
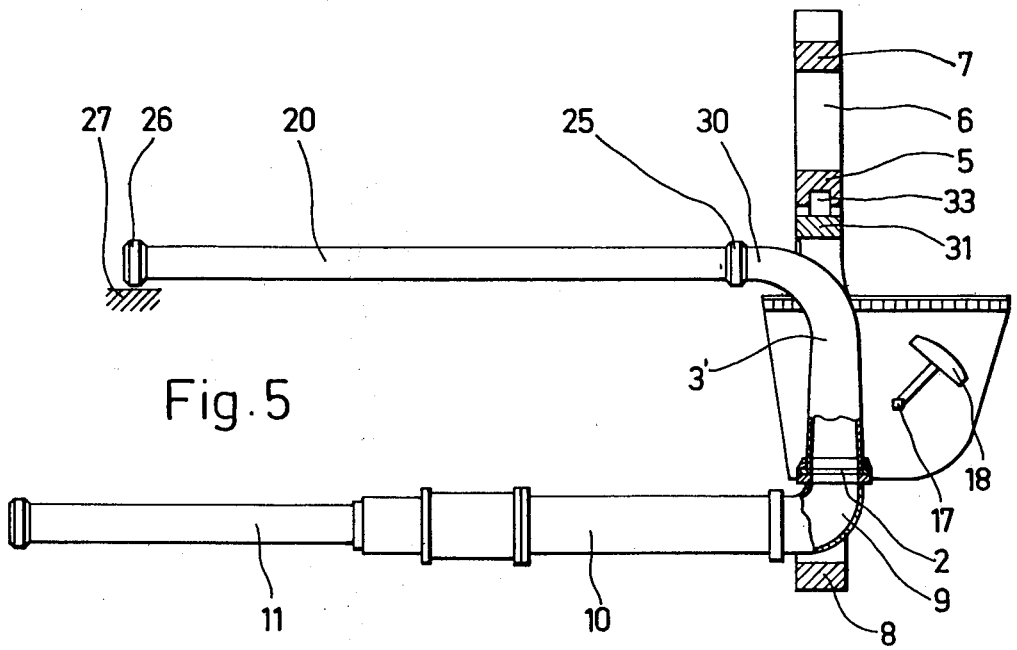
FIG. 5 shows a modification of the apparatus of FIG. 1 in a corresponding view.
Figure 6:
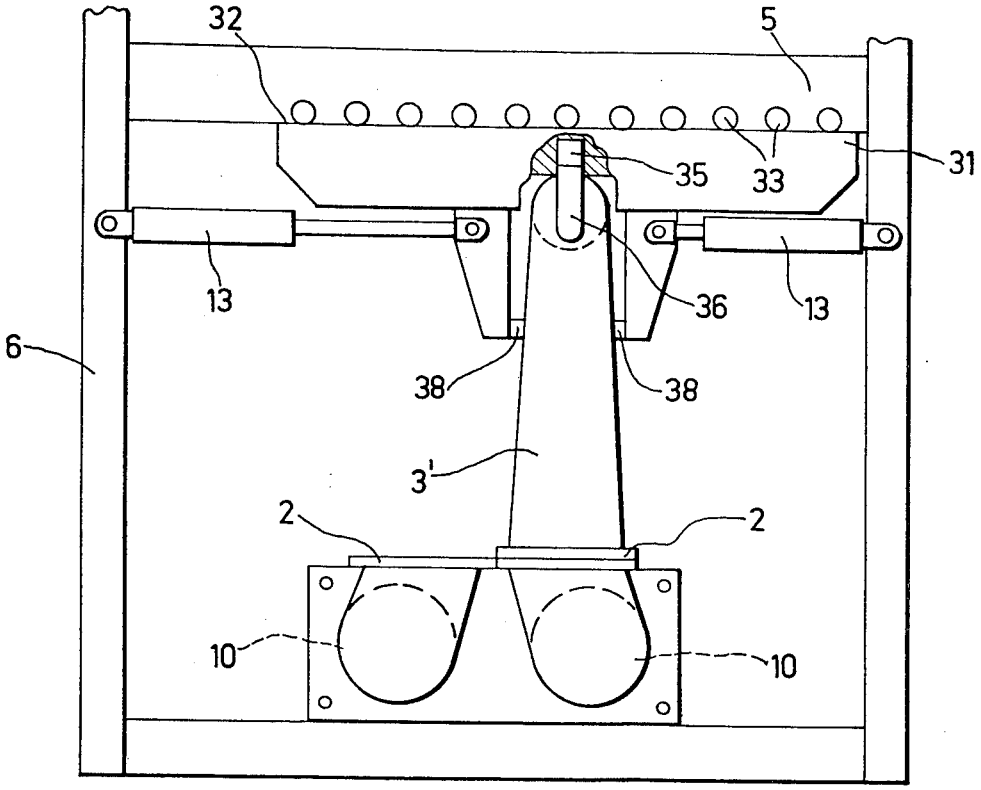
FIG. 6 is a fragmentary rear elevation of the apparatus of FIG. 5, one element being partly broken away to reveal internal features.

The modified pump arrangement shown in FIG. 5 and also in FIG. 6 on a somewhat larger scale has a connector 3′ which is a rectangularly bent tube. As is shown in FIG. 5, the shorter horizontal leg of the tube is fixedly fastened to one end of the discharge conduit 20 by flanges 25, the other end of the conduit 20 being mounted on a portion 27 of the stationary supporting structure by a universal joint 26. A guide rail 31 has a top face 32 which engages rollers 33 partly recessed in the bottom face of the beam 5. The guide rail 31 is parallel to the beam 5, and its length, combined with the center-to-center spacing of the openings 2, is only slightly smaller than the length of the beam 5 between the columns 6. Two hydraulic motors 13 are interposed between the columns 6 respectively and abutments 38 which depend from the guide rail 31.

A cylindrical pivot pin 36 coaxially attached to the upright leg of the connector 3′ at the bend of the latter is rotatably and axially slidably sealed in a blind vertical bore 35 of the rail 31 which is connected with the hydraulic system of the pump arrangement as described with reference to the cylinder space 12 shown in FIG. 2. The abutments 38 are spaced longitudinally of the rail 31 at a distance equal to the corresponding dimensions of the connector 3 so that the latter is moved with the rail 31 by the hydraulic motors 13 between the two openings 2 while being permitted to turn about the axis of the pivot pin 36, and being held in tight engagement with the bottom wall of the bin 1, omitted from FIG. 6, by hydraulic pressure acting on the pivot pin 36. The rail 31 does not take part in the angular movement of the connector 3′, and its relatively great length contributes to the precise positioning of the connector 3′.

Figure 7:
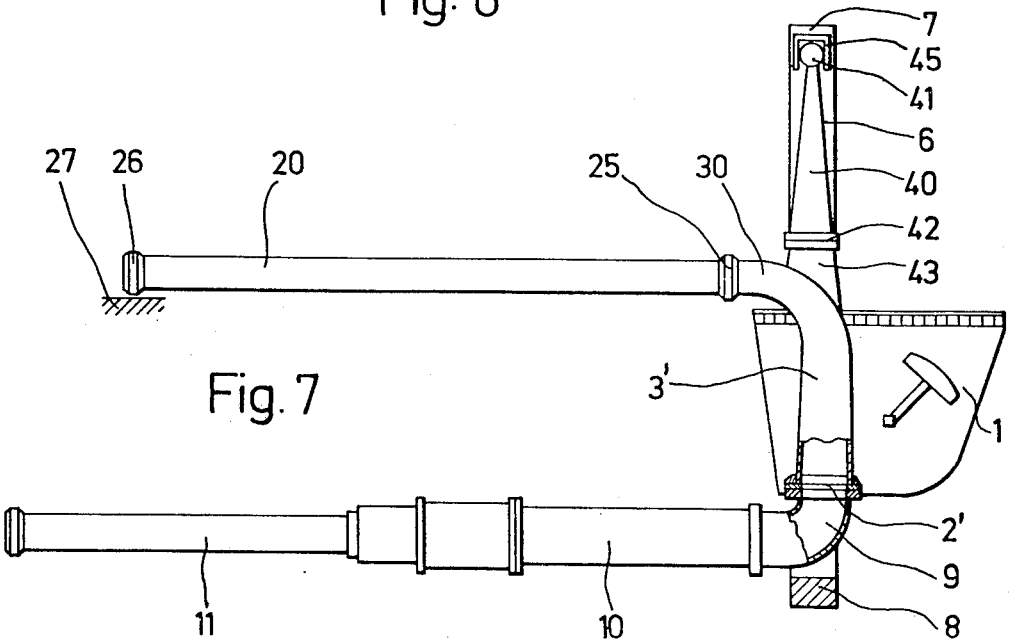
FIG. 7 shows yet another modification of the apparatus of FIG. 1 in a corresponding view.
Figure 8:
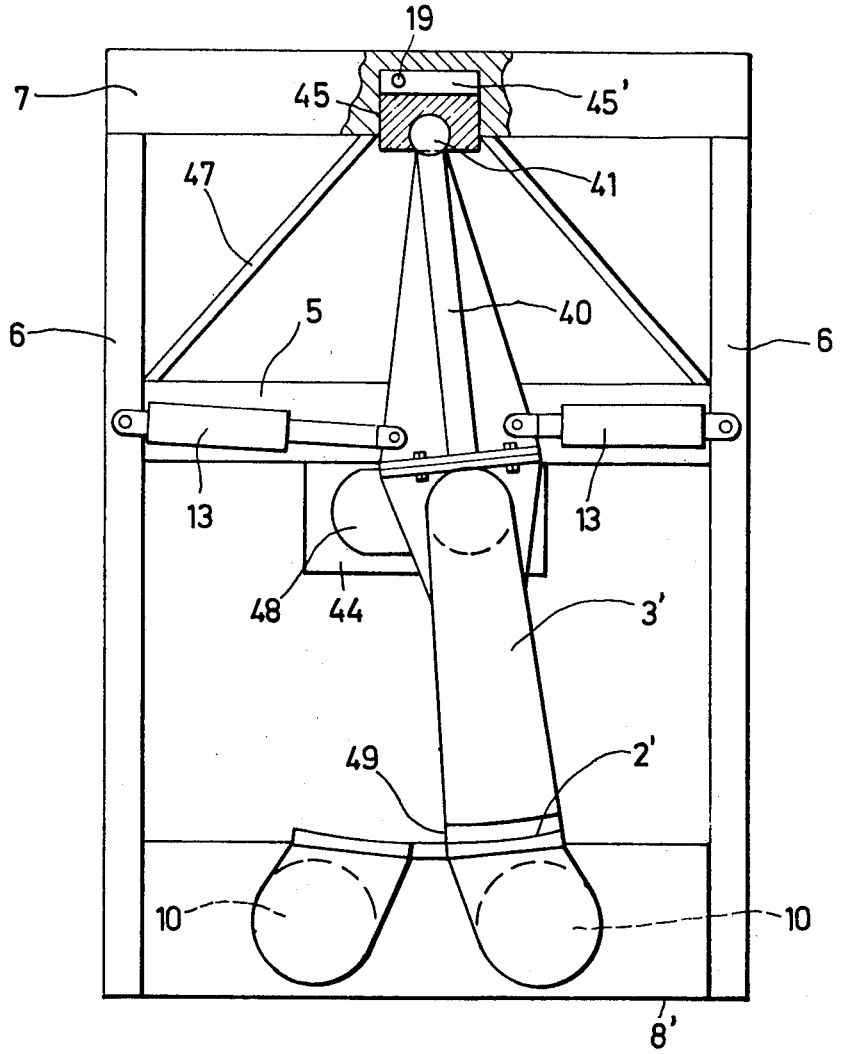
FIG. 8 shows the apparatus of FIG. 7 in fragmentary rear elevation.

The apparatus illustrated in FIGS. 1 – 6 has connectors which are shifted angularly about a vertical axis or shifted in an almost straight horizontal line between their two terminal positions. FIGS. 7 and 8 illustrate yet another modification of the apparatus shown in FIGS. 1 and 2, in which a connector 3′, corresponding to the connector seen in FIGS. 5 and 6, is shifted angularly about a horizontal axis, the apparatus being practically identical with that described with reference to FIGS. 5 and 6 as far as not stated otherwise.

An arm projects from the bend of the tubular connector 3′ coaxially with the upright leg of the connector. The lower arm portion 43 is directly welded to the connector 3′ and connected by flanges 42 to the upper arm portion 40 whose upper end carries a ball 41. A downwardly open cylinder space 45′ in the beam 7 receives a piston 45 partly hollow to provide a socket for the ball 41. Diagonal stiffening braces 47 extend from the beam 7 adjacent the cylinder space 45′ to the junctures of the beam 5 with the columns 6.

Hydraulic motors 13 connect the upper arm portion 40 to the columns 6 respectively and pivot the connector 3′ about the center of the ball-and-socket joint 41, 45 in a plane parallel to that of FIG. 8 while permitting the necessary limited rotation of the connector. The horizontal leg of the connector is guided in an aperture 48 of a plate 44 depending from the beam 5.

A ring 49 rotatable on the lower end of the connector 3′ defines the lower orifice of the connector. The exposed faces of the rims 2′ about the two openings in the bin bottom, not itself shown in FIG. 8, extend in a common cylindrical surface about the center of rotation of the ball-and-socket joint 41, 45 and maintain a tight seal with the correspondingly shaped ring 49 in all angular positions of the connector 3′.

It should be understood, of course, that the foregoing disclosure relates only to preferred embodiments of the invention, and that it is intended to cover all changes and modifications of the examples of the invention herein chosen for the purpose of the disclosure which do not constitute departures from the spirit and scope of the appended claims.

What is claimed is:

1. A slurry pump arrangement comprising, in combination:

a. a container bounding a cavity adapted to hold a fluid concrete mixture, said container having a bottom wall downwardly bounding said cavity and formed with two spaced openings;

b. two pump means including respective pump cylinders communicating with said openings respectively for pumping said mixture through said openings;

c. a tubular connector having two terminal orifices respectively adjacent said openings in said cavity and upwardly spaced from said openings in the operative condition of said arrangement;

d. a rigid support fixedly fastened to said container and including a frame having two upright column members and at least two transverse beam members connecting said column members and vertically spaced from each other, one of said beam members being vertically spaced from said cavity and from another beam member in an upward direction, said connector being movably supported by said one beam member;

e. a discharge conduit connected to said upwardly spaced orifice; and f. operating means for shifting said connector on said one beam member between two positions in which said adjacent orifice substantially sealingly engages said bottom wall about said openings respectively and thereby connects one of said pump cylinders to said discharge conduit, while the other pump cylinder communicates with said cavity.

2. An arrangement as set forth in claim 1, further comprising pivot means connecting said connector to said one beam member for angular movement about an upright axis.

3. An arrangement as set forth in claim 1, further comprising a bearing connecting said connector to said one beam member for angular movement about an upright axis, said bearing bounding a cylinder space, piston means on said connector member axially slidably engaging said bearing in said cylinder space, and means for admitting fluid under pressure to said cylinder space for thereby biasing said connector axially outward of said cylinder space.

4. An arrangement as set forth in claim 1, further comprising cooperating abutment means on said connector and on said one beam member for limiting movement of said adjacent orifice vertically away from the engaged bottom wall of said container.

5. An arrangement as set forth in claim 1, wherein said discharge conduit is horizontally elongated, one longitudinal end portion of said discharge conduit being fixedly fastened to said connector for movement therewith, and pivot means pivotally securing the other longitudinal end portion of said discharge conduit to said support.

6. An arrangement as set forth in claim 5, further comprising guide means guiding said connector on said support for movement transversely to the direction of elongation of said discharge conduit.

7. An arrangement as set forth in claim 6, wherein said guide means include a guide rail attached to said connector, said guide rail and said one beam member being elongated in a common horizontal direction, the length of said one beam member between said column members exceeding the length of said guide member by more than the center-to-center spacing of said openings, but by not more than twice said center-to-center spacing.

8. An arrangement as set forth in claim 7, further comprising pivot means connecting said guide rail to said connector for relative angular displacement about a vertical axis.

9. An arrangement as set forth in claim 1, further comprising a ball-and-socket joint pivotally connecting said connector to said one beam member.

10. A slurry pump arrangement comprising, in combination:

a. a container bounding a cavity adapted to hold a fluid concrete mixture, said container having a bottom wall downwardly bounding said cavity and formed with two spaced openings therethrough;

b. two pump means including respective pump cylinders communicating with said openings respectively for pumping said mixture through said openings;

c. a tubular connector having two terminal orifices respectively adjacent said openings in said cavity and upwardly spaced from said openings in the operative condition of said arrangement for flow of the pumped mixture through said connector from said adjacent orifice to said upwardly spaced orifice;

d. a rigid support fixedly fastened to said container, a portion of said support being upwardly spaced from and outside said cavity, said connector being movably mounted on said portion of said support;

e. a discharge conduit connected to said upwardly spaced orifice; and f. operating means for shifting said connector relative to said portion of said support between two positions in which said adjacent orifice substantially sealingly engages said bottom wall about said openings respectively and thereby connects one of said pump cylinders to said discharge conduit, while the other pump cylinder communicates with said cavity.

11. An arrangement as set forth in claim 10, wherein said portion of said support includes bearing means movably engaging said connector and constituting the sole means for transmitting to said support the forces exerted on said connector by said pumped mixture flowing from said adjacent orifice to said upwardly spaced orifice.

12. An arrangement as set forth in claim 11, wherein said tubular support has the approximate shape of a stretched-out S.

13. An arrangement as set forth in claim 10, wherein said portion of said support is integral with said container.

* * * * *